US007515849B2

(12) United States Patent
Iketani

(10) Patent No.: US 7,515,849 B2
(45) Date of Patent: Apr. 7, 2009

(54) IMAGE FORMING APPARATUS WITH A SWING-DOOR THAT MOVES AWAY FROM A SHEET CONVEYANCE PATH DURING OPENING OF THE SWING-DOOR

(75) Inventor: Takeshi Iketani, Osaka (JP)

(73) Assignee: Kyocera Mita Corporation (JP)

( * ) Notice: Subject to any disclaimer, the term of this patent is extended or adjusted under 35 U.S.C. 154(b) by 396 days.

(21) Appl. No.: 11/334,851

(22) Filed: Jan. 18, 2006

(65) Prior Publication Data

US 2006/0159488 A1 Jul. 20, 2006

(30) Foreign Application Priority Data

Jan. 19, 2005 (JP) ..... 2005-011265

(51) Int. Cl.
*G03G 21/00* (2006.01)

(52) U.S. Cl. ..... 399/124

(58) Field of Classification Search ..... 399/124, 399/397, 401, 405; 271/184–186
See application file for complete search history.

(56) References Cited

U.S. PATENT DOCUMENTS 5,280,331 A * 1/1994 Namiki ..... 399/124
5,337,134 A * 8/1994 Sato et al. ..... 399/124
6,078,765 A 6/2000 Takano et al.
6,134,404 A * 10/2000 Iwai et al. ..... 399/110
6,553,207 B2 * 4/2003 Tsusaka et al. ..... 399/401
6,564,019 B2 * 5/2003 Ahn et al. ..... 399/13
6,876,830 B2 4/2005 Ohgita et al.
2005/0163533 A1 * 7/2005 Hashimoto et al. ..... 399/124

FOREIGN PATENT DOCUMENTS

JP 08104449 A * 4/1996
JP 9-328249 12/1997
JP 10288936 A * 10/1998
JP 2003295732 A * 10/2003

* cited by examiner

*Primary Examiner*—Robert Beatty
(74) *Attorney, Agent, or Firm*—Gerald E. Hespos; Anthony J. Casella

(57) ABSTRACT

In an image forming apparatus (10), one (wall surface (201)) of facing wall surfaces of an inverting conveyance path (R3) for turning a sheet (P), which had a toner image formed after an image forming operation in an image forming unit (13) fixed thereto, front side back is formed on a swing door (20) openably and closably provided on an apparatus main body (11). A swing-door supporting structure (30) is provided to rotatably support the swing door (20) at positions of supporting points of rotation of the swing door (20) (center axis positions of shaft main bodies (41)). The swing-door supporting structure (30) is so constructed as to ensure a specified width of the inverting conveyance path (R3) with the swing door (20) closed while moving the swing door (20) in a direction away from the inverting conveyance path R3 by opening the swing door (20).

7 Claims, 5 Drawing Sheets

IMAGE FORMING APPARATUS WITH A SWING-DOOR THAT MOVES AWAY FROM A SHEET CONVEYANCE PATH DURING OPENING OF THE SWING-DOOR

BACKGROUND OF THE INVENTION

1. Field of the Invention

The present invention relates to an image forming apparatus such as a copier, a facsimile apparatus or a printer connected with a computer.

2. Description of the Related Art

As disclosed in Japanese Unexamined Patent Publication No. H09-328249, there has been conventionally known an image forming apparatus constructed such that a sheet having a toner image already fixed thereto and horizontally conveyed from an image forming unit via a fixing unit is discharged on an interior discharge tray via an inverting conveyance path extending upward while being turned an upside-down (so-called faced-down state).

The inverting conveyance path is defined between a wall surface of an apparatus main body and an inner wall surface of a swing door mounted at the apparatus main body in such a manner as to be openable and closable with a suitable position downstream of the fixing unit as a supporting point of rotation by being turned in forward and reverse directions.

Accordingly, in the case of a paper jam in the inverting conveyance path, the sheet jammed in the inverting conveyance path is exposed to the outside by opening the swing door. Thus, the paper jam is solved by removing the sheet exposed to the outside from the inverting conveyance path.

In addition to the fact that it is sufficient for the inverting conveyance path to have such a width as to enable the passage of the sheet, the swing door is preferably arranged as close as possible to the wall surface of the apparatus main body defining the inverting conveyance path in order to make the apparatus smaller in size. However, if the swing door is too close to the wall surface, a bottom end portion thereof comes to interfere with the fixing unit when the swing door is opened. Therefore, the supporting point of rotation is normally located at a position appropriately distanced from the fixing unit.

Accordingly, the supporting point of rotation of the swing door is set at such a position that the swing door does not interfere with the fixing unit upon being opened and that is maximally close to the fixing unit. Even with such an arrangement, a part of the swing door below the supporting point of rotation projects toward the inverting conveyance path with the swing door opened. This projecting bottom end portion of the swing door presses the sheet having caused the paper jam against the fixing unit and the sheet is squeezed between the swing door and the wall surface of the fixing unit. Therefore, there has been a problem that the jammed sheet cannot be easily removed.

SUMMARY OF THE INVENTION

In view of the problems residing in the prior art, an object of the present invention is to provide an image forming apparatus in which a sheet jammed in an inverting conveyance path can be easily removed to thereby improve operability in removing the jammed sheet.

In order to accomplish the above object, the invention is directed to an image forming apparatus having a swing door provided on an apparatus main body, comprising a swing-door supporting structure for rotatably supporting the swing door at a position of a supporting point of rotation; and an inverting conveyance path for discharging a sheet while inverting the sheet, wherein the swing-door supporting structure forms the inverting conveyance path of a specified width with the swing door closed while opening the swing door such that the swing door is moved in a direction away from the inverting conveyance path.

With this construction, the specified width of the inverting conveyance path can be ensured with the swing door closed, thereby properly defining the inverting conveyance path for discharging the sheet after a fixing processing while turning the sheet front side back. On the other hand, since the bottom end thereof is distanced in the direction away from the inverting conveyance path with the swing door opened, a sufficient space can be defined between the position of the supporting point of rotation of the opened swing door and the wall surface of the apparatus main body. Accordingly, in the case of a paper jam in the inverting conveyance path, the jammed sheet can be easily removed because of the presence of the sufficient space defined by opening the swing door.

BRIEF DESCRIPTION OF THE DRAWINGS

FIGS. 2A and 2B are partial perspective views of a swing door showing one embodiment of a swing-door supporting structure according to the invention, wherein FIG. 2A is an exploded perspective view and FIG. 2B is a perspective view showing an assembled state.

FIGS. 5A and 5B are diagrams showing the action of the swing-door supporting structure, wherein FIG. 5A shows the state where the swing door is set in the closed posture and FIG. 5B shows the state where the swing door is set in the opened posture.

DETAILED DESCRIPTION OF THE PREFERRED EMBODIMENTS

Figure 1:
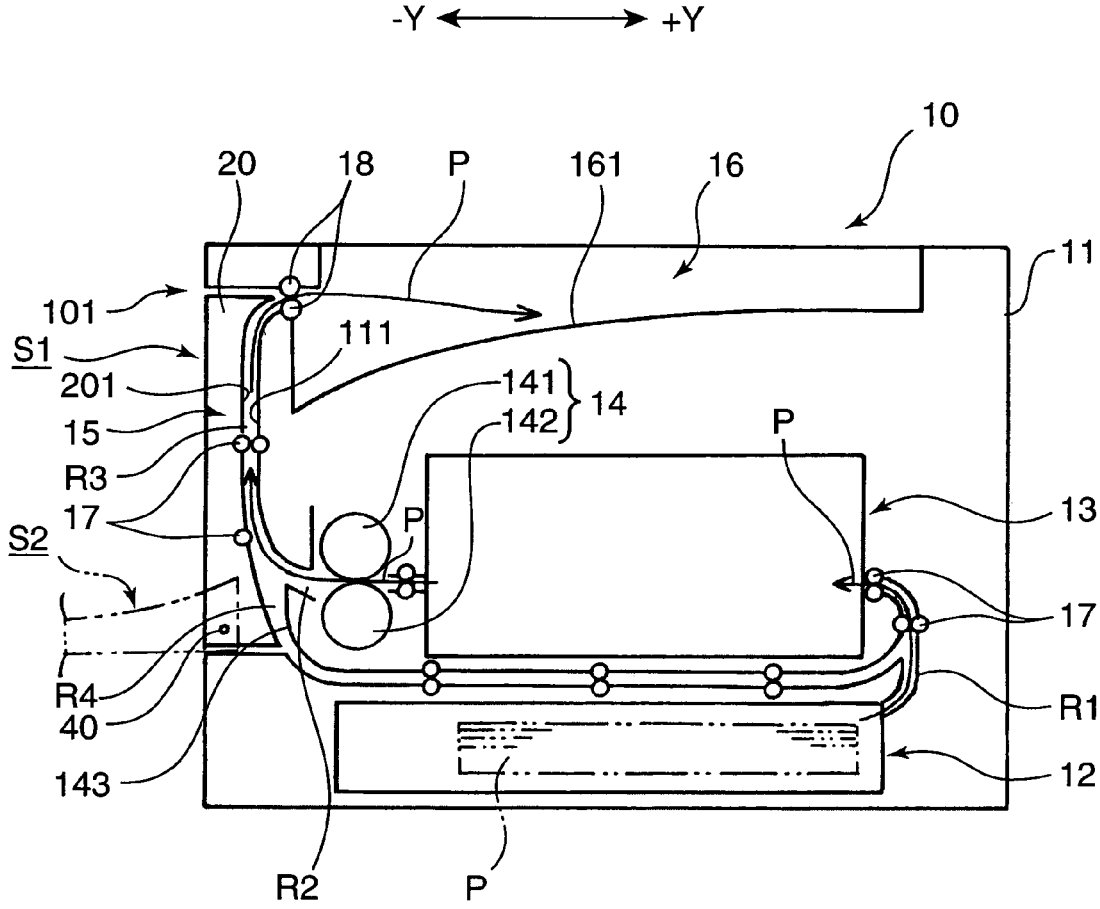
FIG. 1 is a front view in section outlining one embodiment of an image forming apparatus according to the invention.

FIG. 1 is a front view in section outlining one embodiment of an image forming apparatus according to the present invention. It should be noted that direction normal to the plane of FIG. 1 is referred to as transverse direction and Y-Y directions are referred to as forward and backward directions, wherein −Y direction is forward direction and +Y direction is backward direction.

As shown in FIG. 1, an image forming apparatus 10 has a basic construction in a box-shaped apparatus main body 11, the basic construction including a sheet storing unit 12 formed to store a plurality of sheets P; an image forming unit 13 for applying an image forming processing to the sheet P conveyed from the sheet storing unit 12 via an upstream-side sheet conveyance path R1; a fixing unit 14 for fixing a toner image onto the sheet P to which the toner image was transferred by the image forming processing in the image forming unit 13; a discharging unit 15 for conveying the sheet P having the toner image fixed in the fixing unit 14 to discharge it; and a discharged-sheet receiving unit 16 for receiving the sheet P conveyed via the discharging unit 15.

The sheet storing unit 12 is provided with a specified sheet tray, and the sheets P are dispensed one by one from a sheet bundle stacked on this sheet tray via a sheet dispensing mechanism such as a pickup roller and introduced to the image forming unit 13 through the upstream-side sheet conveyance path R1 by driving conveyance rollers 17 provided at specified positions.

The image forming unit 13 is provided with a photosensitive drum rotatable about its center axis; a charging device for applying a voltage to the outer circumferential surface of the rotating photosensitive drum to uniformly charge this outer circumferential surface; an exposing device for irradiating a laser beam having varying intensity and based on electrically transmitted image information to the outer circumferential surface of the charged photosensitive drum to form an electrostatic latent image on this outer circumferential surface; a developing device for supplying toner to the electrostatic latent image on the outer circumferential surface of the photosensitive drum formed by the exposing device to form a toner image; a transfer-roller for transferring the toner image on the outer circumferential surface of the photosensitive drum to the sheet P conveyed by turning a conveyor belt; a cleaning device for cleaning the outer circumferential surface of the photosensitive drum after the transfer of the toner image by removing the residual toner; and a charge removing device for removing a residual charge on the outer circumferential surface of the photosensitive drum after the cleaning processing.

The sheet P conveyed from the sheet storing unit 12 to the image forming unit 13 via the upstream-side sheet conveyance path R1 has the toner image on the outer circumferential surface of the photosensitive drum transferred thereto by being tightly held between the photosensitive drum and the transfer roller together with the conveyor belt while being conveyed by the conveyor belt. The sheet P having the toner image formed on the upper surface thereof upon the completion of the transferring processing is fed to the fixing unit 14 via the conveyance rollers 17 provided at a downstream end of the image forming unit 13.

The fixing unit 14 fixes the toner to the sheet P by a heat treatment, and includes a fixing roller 141 having a heat source such as an electric heating element therein and a pressure roller 142 located below and opposed to the fixing roller 141. The sheet P conveyed from the image forming unit 13 has the toner image fixed thereto by being conveyed while being nipped between the rotating fixing roller 141 and the rotating pressure roller 142.

Such a fixing unit 14 is formed with a downstream-side conveyance path R2 extending from the downstream end of the image forming unit 13 to an inverting conveyance path R3 to be described later via a nip position (position where the fixing roller 141 and the pressure roller 142 are in contact) by the fixing roller 141 and the pressure roller 142.

The discharging unit 15 is for conveying the sheet P having the fixing processing applied thereto by the fixing unit 14 to a more downstream side, and includes a swing door 20 for opening and closing an opening 101 formed in the left side surface of the apparatus main body 11 in FIG. 1 by being turned in forward and reverse directions about rotary shafts 40. The rotary shafts 40 integrally project from the wall surfaces of a bottom part of the swing door 20 in opposite directions (directions normal to the plane of FIG. 1) along a sheet width direction normal to a sheet conveying direction, and are rotatably supported on later-described frame plates 19 (see FIGS. 2 and 5) of the apparatus main body 11, whereby the swing door 20 can be integrally rotated in forward and reverse directions about the rotary shafts 40 to change its posture between a closed position S1 shown in solid line in FIG. 1 and an opened posture S2 shown in phantom line in FIG. 1. The swing door 20 is manually opened and closed by a user.

With the swing door 20 set in the opened posture S2, the upper surface thereof is located below the downstream-side sheet conveyance path R2, whereby the sheet P having exited the fixing unit 14 moves straight forward to be received onto the swing door 20 with the image-transferred surface faced up. In other words, the swing door 20 functions as a face-up discharge tray while being set in the opened posture S2.

In the discharging unit 15, the inverting conveyance path R3 for allowing the sheet P after the fixing processing to move toward the discharged-sheet receiving unit 16 is defined between a wall surface 201 of the swing door 20 set in the closed posture S1 and a wall surface 111 of the apparatus main body 11 that is located above the nip position of the fixing unit 14 and opposed to the wall surface 201, and a returning conveyance path R4 for returning the sheet P back to the image forming unit 13 is defined between the wall surface 201 of the swing door 20 below the nip position and a wall surface 143 (wall surface facing the apparatus main body 11) of a casing of the fixing unit 14 facing the swing door 20.

The returning conveyance path R4 is used to apply duplex printing to the sheet P. Specifically, after the sheet P having the toner image transferred to one surface (front surface) thereof has the toner image fixed thereto, this sheet P is temporarily introduced to the inverting conveyance path R3, then introduced to the returning conveyance path R4 by driving the conveyance rollers 17 disposed along the inverting conveyance path R3 in reverse directions, and turned upside down or front side back by being introduced into the upstream-side sheet conveyance path R1 from the downstream end of the returning conveyance path R4, and a toner-image is transferred to the back surface of the sheet P turned upside down by introducing the sheet P into the image forming unit 13. The sheet P having printing completed on both surfaces is discharged onto the discharge-sheet receiving unit 16 through the inverting conveyance path R3.

The discharge-sheet receiving unit 16 is for receiving the sheet P discharged through the inverting conveyance path R3 by driving discharge rollers 18 and includes a face-down discharge tray 161. Since the sheet P discharged onto the face-down discharge tray 161 had a conveying direction turned by passing through the inverting conveyance path R3, the image-transferred surface thereof is faced down.

Figure 2A:
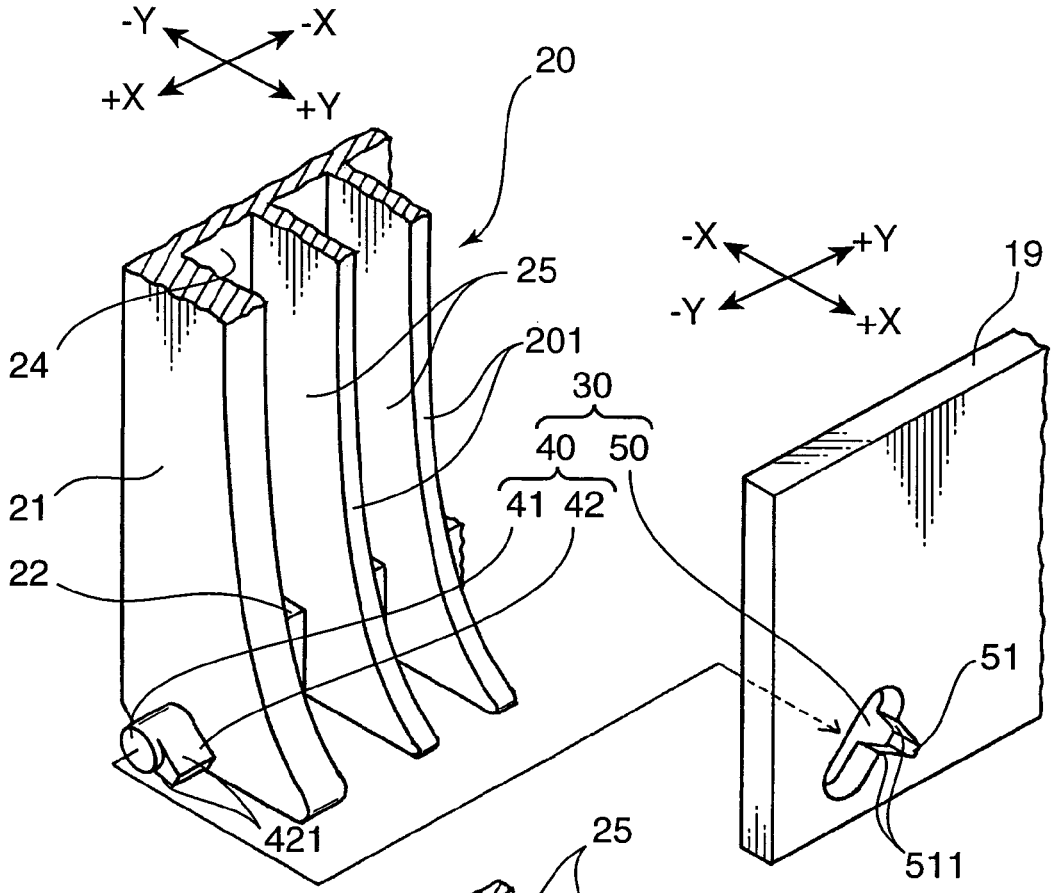
Figure 2B:
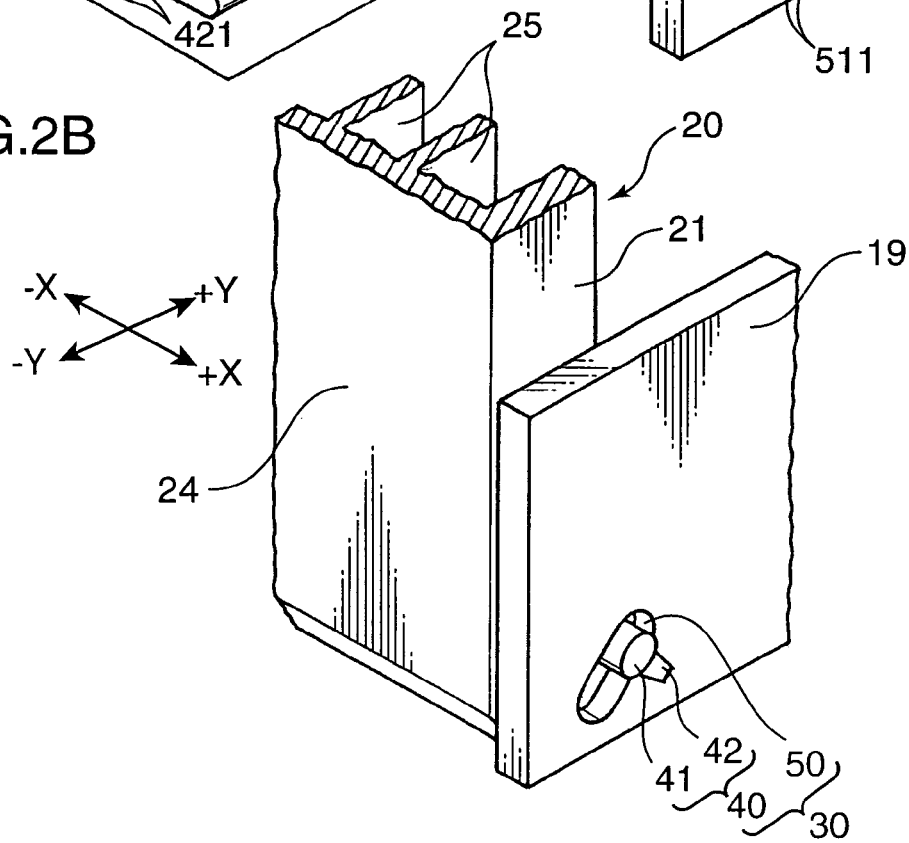
Figure 3:
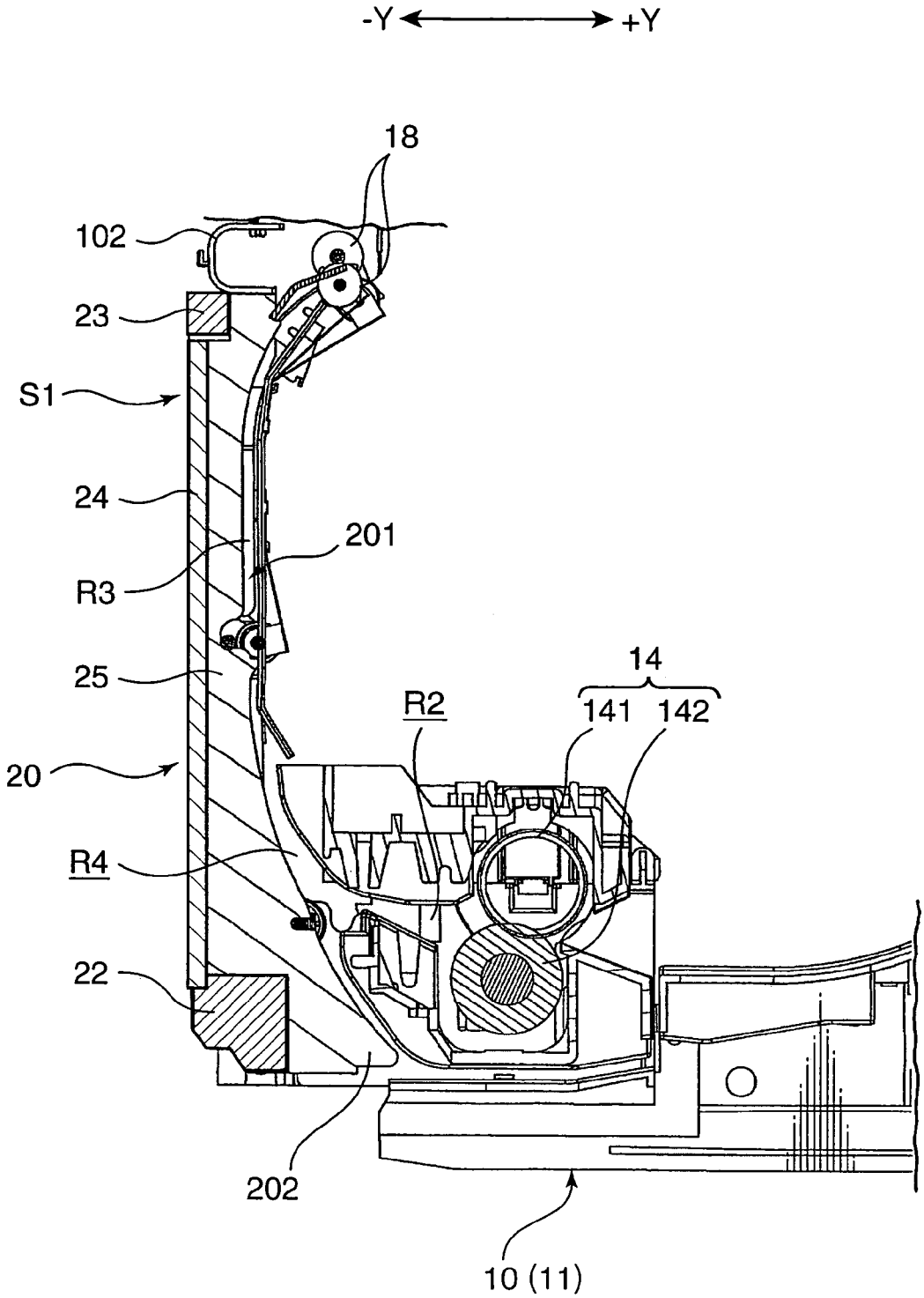
FIG. 3 is a section of the swing door of FIG. 2 showing a state where the swing door is set in a closed posture.
Figure 4:
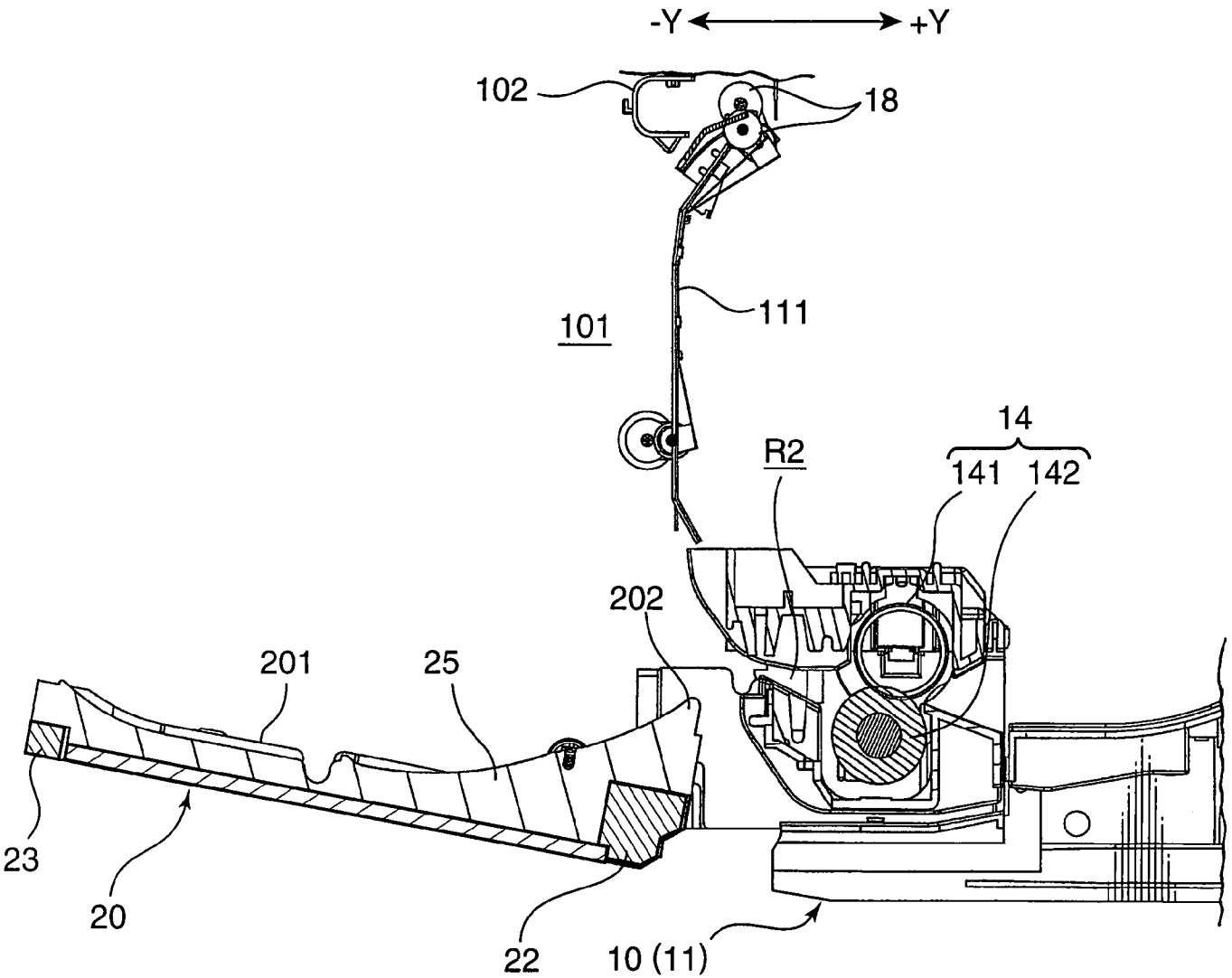
FIG. 4 is a section of the swing door of FIG. 2 showing a state where the swing door is set in an opened posture.

FIGS. 2A and 2B are partial perspective views of the swing door 20 showing one embodiment of a swing-door supporting structure according to the present invention, wherein FIG. 2A is an exploded perspective view and FIG. 2B is a perspective view showing an assembled state. Further, FIGS. 3 and 4 are sections of the swing door 20 shown in FIG. 2, wherein FIG. 3 shows a state where the swing door 20 is set in the closed posture S1 and FIG. 4 shows a state where the swing door 20 is set in the opened posture S2. In FIGS. 2 to 4, X-X directions and Y-Y directions are respectively referred to as transverse direction and forward and backward directions. Particularly, −X direction is referred to as leftward direction; X-direction as rightward direction; −Y direction as forward direction; and Y-direction as backward direction.

The swing door 20 includes a pair of left and right side plates 21 (only the right side plate 21 is shown in FIG. 2) extending in vertical direction in FIG. 2, a lower frame 22 in the form of a rectangular beam extending between the bottom ends of the side plates 21, an upper frame 23 in the form of a rectangular beam extending between the upper ends of the side plates 21 (see FIG. 3), a rectangular front plate 24 extending between the lower and upper frames 22, 23 and between the side plates 21, and a plurality of guide fins 25 projecting backward side by side along transverse direction from the front plate 24 and extending between the lower and upper frames 22, 23.

Each of the plurality of guide fins 25 has an upper part and a lower part gradually extending more inward of the apparatus main body 11 toward the top and toward the bottom, thereby having a concave shape, and is arch-shaped as a whole. The wall surface 201 of the swing door 20 at the inverting conveyance path R3 and the returning conveyance path R4 are defined by the rear edge surfaces of such guide fins 25.

On the other hand, a pair of left and right frame plates 19 (only the right frame plate 19 is shown in FIG. 2) for supporting the swing door 20 are provided at bottom positions of the front end of the apparatus main body 11, and is so supported as to be openable and closable by a swing-door supporting structure 30 formed at the pair of frame plates 19 and the swing door 20.

As shown in FIG. 2A, the swing-door supporting structure 30 includes a pair of left and right rotary shafts 40 integrally projecting in opposite directions from bottom end portions of the respective side plates 21, and a pair of left and right inclined oblong holes (oblong holes) 50 formed in front bottom parts of the respective frame plates 19 in correspondence with the rotary shafts 40.

Each rotary shaft 40 is comprised of a cylindrical shaft main body 41 and a guidable projection (projection) 42 radially projecting from the outer circumferential surface of the shaft main body 41. A supporting point of rotation of the swing door 20 is defined at the center axis positions of the shaft main bodies 41. Each guidable projection 42 is tapered toward the leading end like a gear tooth and has a pair of inclined surfaces 421 at its opposite sides with respect to circumferential direction. With the swing door 20 set in the closed posture S1 as shown in FIG. 3, the rotary shafts 40 project from the side plates 21 such that the guidable projections 42 are slightly sloped down toward the back as shown in FIG. 2A.

As shown in FIG. 2A, each inclined oblong hole 50 has a width set to be slightly larger than the diameter of the shaft main body 41 and is inclined down from a rear side toward a front side. Such an inclined oblong hole 50 is formed with a recessed groove 51 inclined obliquely downward toward the back from an upper position of the rear inclined edge thereof. This recessed groove 51 has a shape substantially similar to and slightly larger than the lateral section (section normal to the center axis of the shaft main body 41) of the guidable projection 42, and inclined edge surfaces 511 corresponding to the inclined surfaces 421 of the guidable projections 42 are defined on the opposed edge surfaces of the recessed groove 51.

Figure 5A:
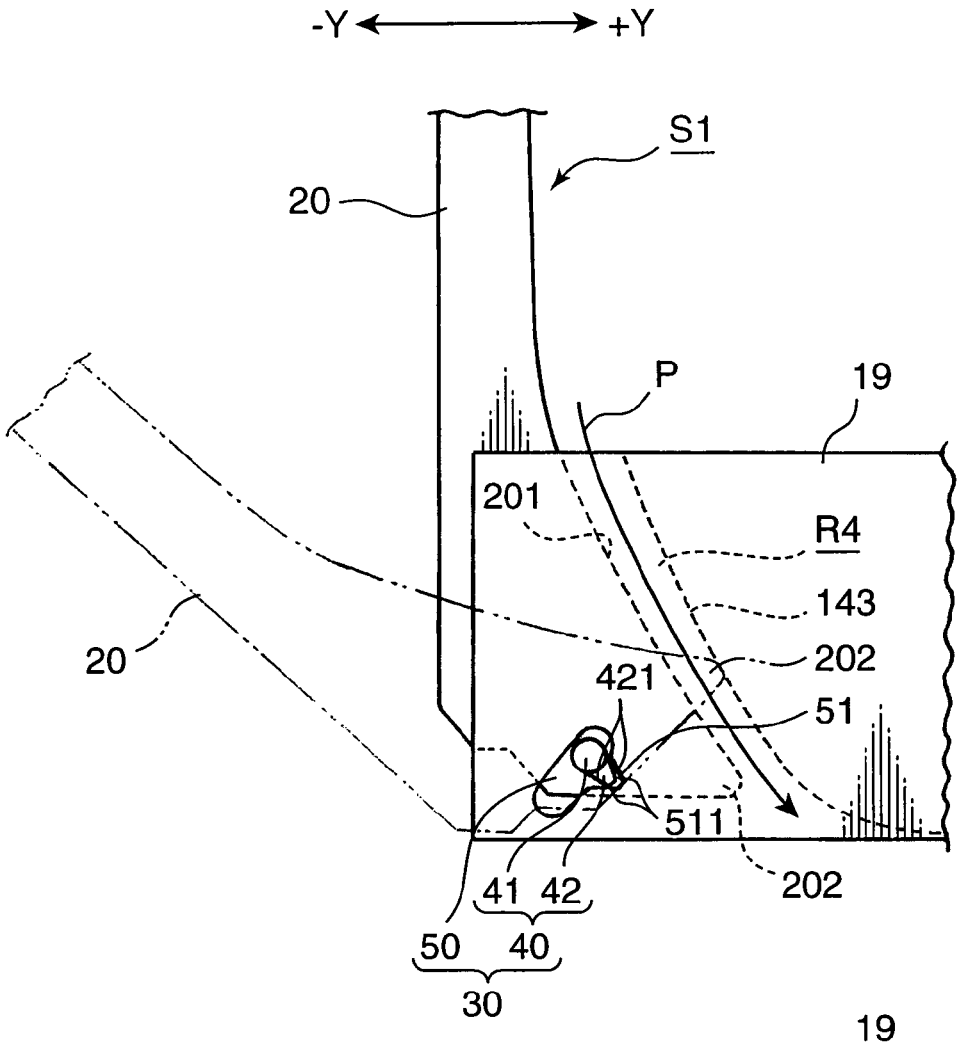
Figure 5B:
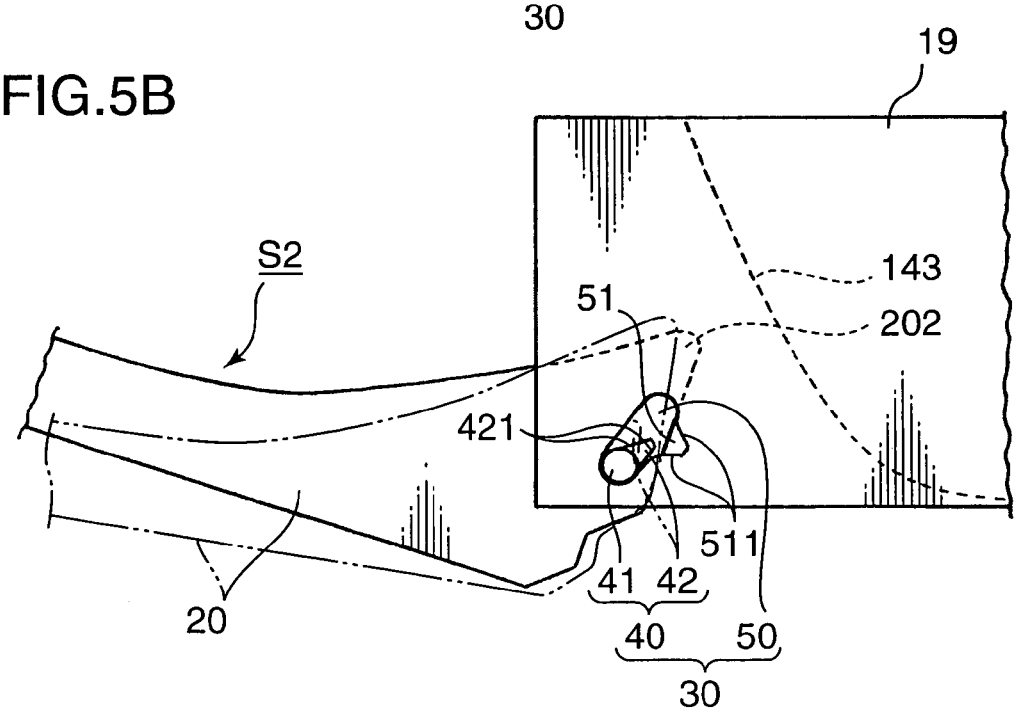

With the shaft main bodies 41 fitted in the inclined oblong holes 50 and located at the bottommost positions in the inclined oblong holes 50, the guidable projections 42 interfere with the rear edges of the inclined oblong holes 50 below the inclined edge surfaces 511 as shown in FIG. 5B, wherefore the swing door 20 is inevitably set in the opened posture S2. The shapes of the guidable projections 42 and the recessed grooves 51 are relatively set such that the leading ends of the guidable projections 42 are located slightly above the lower inclined edge surfaces 511 of the inclined oblong holes 50.

Accordingly, by closing the swing door 20 set in the opened posture S2 (see FIG. 4) to change the posture of the swing door 20 to the closed posture S1, the lower inclined surfaces 421 of the guidable projections 42 come to mesh with the lower inclined edge surfaces 511 of the recessed grooves 51 as shown in FIG. 5A, whereby the guidable projections 42 climbs up onto the lower inclined surfaces 511 of the recessed grooves 51. Thus, the rotary shafts 40 consequently move up in the inclined oblong holes 50 as the guidable projections 42 climb up. Finally, as shown in FIG. 5A, the shaft main bodies 41 are located at the uppermost positions in the inclined oblong holes 50 and the guidable projections 42 are fitted into the recessed grooves 51.

Contrary to this, if the swing door 20 set in the closed posture S1 is opened, the shaft main bodies 41 rotate counterclockwise about their center axes, whereby the leading ends of the guidable projections 42 interfere with the upper inclined edge surfaces 511 of the recessed grooves 51 as shown in FIG. 5A, whereby forces act on the shaft main bodies 41 in downward direction. Thus, the shaft main bodies 41 move downward in the inclined oblong holes 50. Accordingly, the rotary shafts 40 return to the bottommost positions in the inclined oblong holes 50 as shown in FIG. 5B with the swing door 20 completely opened.

In this embodiment, the swing door 20 rests on an unillustrated frame of the apparatus main body 11 to hold the guidable projections 42 in contact with the rear edges of the inclined oblong holes 50 as shown in solid line in FIG. 5B. However, even if the swing door 20 is not held in contact with the frame, the guidable projections 42 act as stoppers to come into contact with the front edges of the inclined oblong holes 50 if the swing door 20 is slightly rotated from a position shown in solid line to a position shown in phantom line in FIG. 5B, whereby the swing door 20 can be kept in the opened posture S2. Therefore, it is not necessary to additionally provide the stoppers for keeping the swing door 20 in the opened posture S2, which can contribute to a reduction in the production cost of the apparatus.

On the other hand, a locking member 102 for locking the swing door 20 in the closed posture Si is provided at a position on the upper edge of the opening 101 of the apparatus main body 11. This locking member 102 is a U-shaped spring member and is fixed to the upper edge of the opening 101 such that an opening of the U-shaped locking-member 102 faces sideways toward the inside of the apparatus main body 11 as shown in FIG. 4. With the swing door 20 set in the closed posture S1 (i.e. closed), the closed posture S of the swing door 20 can be kept by a pressing force resulting from the resilient deformation of the locking member 102 as shown in FIG. 3.

Hereinafter, the action of the swing-door supporting structure 30 according to the present invention is described with reference to FIGS. 5A and 5B, and also to FIGS. 1 to 4 if necessary. FIGS. 5A and 5B are diagrams showing the action of the swing-door supporting structure 30, wherein FIG. 5A shows the state where the swing door 20 is set in the closed posture S and FIG. 5B shows the state where the swing door is set in the opened posture S2. Directions indicated by Y in FIG. 5 are similar to those shown in FIG. 2, i.e. −Y direction is forward direction and +Y direction is backward direction. In FIG. 5A, a state where the swing door 20 is rotated counterclockwise about the shaft main bodies 41 with the shaft main bodies 41 kept at the upper positions in the inclined oblong holes 50 is shown in phantom line as a comparative example.

As shown in solid line in FIG. 5A, with the swing door 20 set in the upright closed posture S1, the shaft main bodies 41 of the rotary shafts 40 are set at upper positions in the inclined oblong holes 50, and the guidable projections 42 of the rotary shafts 40 are fitted in the recessed grooves 51 of the inclined oblong holes 50, whereby the swing door 20 is stably kept in the closed posture S1.

With the swing door 20 set in the closed posture S1, the returning conveyance path R4 of a specified width is defined between the rear wall surface 201 of the swing door 20 and the wall surface 143 of the fixing unit 14 (see FIG. 1), so that the sheet P having one surface printed during the duplex printing can be returned to the image forming unit 13 (see FIG. 1) through this returning conveyance path R4. Although not shown in FIG. 5, the inverting conveyance path 3 of a specified width is also defined (see FIG. 3).

If the swing door 20 is rotated counterclockwise about the shaft main bodies 41 of the swing door 20 in order to open the swing door 20, the guidable projections 42 integral to the shaft main bodies 41 are rotated counterclockwise together about the center axes of the shaft main bodies 41 and the upper inclined surfaces 421 of the guidable projections 42 interfere with the upper inclined edge surfaces 511 of the inclined oblong holes 50. Thus, the shaft main bodies 41 move downward in the inclined oblong holes 50 by reaction forces acting at this time.

When the swing door 20 is set in the opened posture S2 by a continuous movement to open the swing door 20, a distance between an angled portion 202 (at the rear bottom end of the swing door 20 (at a side of the supporting point of rotation of the swing door 20) and the wall surface 143 of the casing of the fixing unit 14 is longer than the one when the swing door 20 is set in the closed posture S1 (i.e. the clearance is widened to permit the passage of the sheet P).

Accordingly, even if a paper jam occurs in the returning conveyance path R4 with the swing door 20 set in the closed posture S1, the clearance between the wall surface 143 of the casing of the fixing unit 14 and the angled portion 202 of the swing door 20 can be widened by opening the swing door 20 and setting it in the opened posture S1. Therefore, the jammed sheet P can be easily removed.

Contrary to this, if only round holes for permitting the insertion of the shaft main bodies 41 are formed in the frame plates 19 instead of the inclined oblong holes 50, the angled portion 202 comes to interfere with the wall surface 143 of the casing of the fixing unit 14 as shown in phantom line in FIG. 5A when the swing door 20 set in the closed posture S1 is opened. Thus, in the case of a paper jam in the returning conveyance path R4, there occurs such an inconvenience that the jammed sheet P is tightly held between the angled portion 202 and the wall surface 143 of the casing of the fixing unit 14 and cannot be easily removed.

Upon closing the swing door 20 set in the opened posture S2, the swing door 20 may be manually rotated clockwise about the shaft main bodies 41. Then, the guidable projections 42 of the rotary shafts 40 climb up along the lower inclined, edge: surfaces 511 of the inclined oblong holes 50 by the clockwise rotation about the center axes of the rotary shafts 40. Thus, the shaft main bodies 41 move upward in the inclined oblong holes 50 while the shaft main bodies 41 are guided by the inclined oblong holes 50, thereby returning to the state shown in FIG. 5A where the guidable projections 42 are fitted in the recessed grooves 51 when the swing door 20 is closed (set in the closed posture S1).

As described in detail above, in the image forming apparatus 10 according to the present invention, one (wall surface 201) of the facing wall surfaces of the returning conveyance path R3 for inverting the sheet P having the toner image formed in the image forming unit 13 fixed thereto is formed on the swing door 20 provided on the apparatus main body 11 in such a manner as to be openable and closable, the swing-door supporting structure 30 for rotatably supporting the swing door 20 is provided at the positions of the supporting points of rotation of the swing door 20 (positions of the center axes of the shaft main bodies 41) and constructed such that the specified width of the inverting conveyance path R3 is given with the swing door 20 closed and the swing door 20 is moved in a direction away from the inverting conveyance path R3 by being opened.

Accordingly, the specified width of the inverting conveyance path R3 is ensured with the swing door 20 closed, whereby the inverting conveyance path R3 for discharging the sheet P after the fixing processing while inverting the sheet P can be suitably defined. On the other hand, since the angled portion 202 of the swing door 20 is distanced away from the inverting conveyance path R3 with the swing door 20 opened, a sufficient space can be provided between the angled portion 202 and the wall surface of the apparatus main body 11 (wall surface 143 of the casing of the fixing unit 14). Therefore, in the case of a paper jam in the inverting conveyance path R3 (in the case of a paper jam in the returning conveyance path R4 in this embodiment), the jammed sheet P can be easily removed in the sufficiently large space formed by opening the swing door 20.

The swing-door supporting structure 30 includes the rotary shafts 40 integrally projecting from the bottom end positions of the swing door 20 along the sheet width direction normal to the sheet conveying direction, and the inclined oblong holes 50 formed in the apparatus main body 11, adapted to support the rotary shafts 40 and inclined downward toward the outer side. Each rotary shaft 40 is provided with the guidable projection 42 fixed in such a manner as to extend in lateral direction toward the inside of the apparatus main body 11 with the swing door 20 closed, whereas each inclined oblong hole 50 is formed at the upper position thereof with the recessed groove 51 into which the guidable projection 42 is fitted with the swing door 20 closed. Thus, when the swing door 20 is opened, the guidable projections 42 of the rotary shafts 40 are disengaged from the recessed grooves 51 of the inclined oblong holes 50 and come to be located at the bottom ends of the inclined oblong holes 50 inclined downward toward the front sides of the rotary shafts 40, thereby being distanced from the opposite wall surface of the inverting conveyance path R3 defined on the apparatus main body 11. On the other hand, as the swing door 20 is closed, the guidable projections 42 provided on the rotary shafts 40 rotatable together with the swing door 20 climb up to the recessed grooves 51 at the upper sides of the inclined oblong holes 50 whose upper sides are located near the inverting conveyance path R3, and are finally completely fitted into the recessed grooves 51. In this way, the swing door 20 can be stably held closed, and the returning conveyance path R4 for permitting the passage of the sheet P can be defined between the wall surface 201 of the swing door 20 and the wall surface 143 of the casing of the fixing unit 14.

As described above, the guidable projections 42 of the rotary shafts 40 are fitted into the recessed grooves 51 of the inclined oblong holes 50 and come out of the recessed grooves 51 as the swing door 20 are closed and opened, wherein the inverting conveyance path R3 is properly defined with the swing door 20 closed and the distances from the swing door 20 to the wall surfaces of the apparatus main body 11 for the inverting conveyance path R3 and the returning conveyance path R4 become longer with the swing door 20 opened. Therefore, the paper jam can be easily solved while the swing-door supporting structure 30 is allowed to have a simple construction.

The swing door 20 can be also used as the discharge tray for receiving the sheet P after the fixing processing by being opened. Upon discharging the sheet P after the fixing processing without inverting it, i.e. in a so-called faced-up state, the swing door 20 is used as the discharge tray. This can contribute to reducing the cost of the apparatus as compared to a case where the discharge tray is separately provided.

Since the upstream end of the inverting conveyance path R3 is connected with the upstream end of the returning conveyance path R4 for returning the sheet P having the toner image fixed on one surface to the image forming unit 13 upon applying duplex printing to the sheet P in this embodiment, the sheet P having the printing on one surface completed is conveyed backward toward the returning conveyance path R4 after being conveyed into the inverting conveyance path R3, thereby being inverted, whereby the sheet P can be returned to the image forming unit 13 in such a state where printing can be made on the other surface (i.e. duplex printing can be applied). Therefore, the versatility of the image forming apparatus 10 can be improved.

The present invention is not limited to the aforementioned embodiment and also embraces the following contents.

Although a printer incapable of reading a document image (i.e. performing printing based on image information electrically sent from a specified computer or a scanner as a single-function machine) is adopted as the image forming apparatus 10 in the foregoing embodiment, the image forming apparatus 10 is not limited to the printer and may be a copier provided with a document reader or a facsimile apparatus for transmitting and receiving image information via a telephone circuit according to the present invention.

Although the apparatus main body 11 is provided with the returning conveyance path R4 for returning the sheet having printing on one surface completed to the image forming unit for duplex printing in the foregoing embodiment, the present invention is not limited to provide the returning conveyance path R4 in the apparatus main body 11 and the returning conveyance path R4 needs not be particularly provided if the image forming apparatus 10 is a single-function machine usable only for one-side printing.

Although the swing door 20 has an additional function as a so-called face-up discharge tray in the case of discharging the sheet P with the printed surface faced up at the time of one-side printing in the foregoing embodiment, the present invention is not limited to the swing door 20 having the additional function as the face-up discharge tray, and an exclusive face-up discharge tray may be provided in addition to the swing door 20.

In the foregoing embodiment, no particular description is given as to whether only one photosensitive drum is adopted in the image forming unit 13 and a monochromatic image transfer (monotone printing) is applied to the sheet P by this single photosensitive drum or photosensitive drums are adopted for various colors (e.g. four colors of yellow, magenta, cyan and black) and color printing is applied by these plurality of photosensitive drums, i.e. a so-called tandem printing method is adopted. This implicitly implies that the present invention is applicable to either type of printing.

Although the sheet conveyance path formed when the swing door 20 is set in the closed posture S1 serves as the inverting conveyance path R3 and the returning conveyance path R4 in the foregoing embodiment, this sheet conveyance path may be used for other purposes. Specifically, utilizing the inner wall surface of the swing door 20 (wall surface 201 defined by the rear edge surfaces of the guide fins 25), the above sheet conveyance path may be adopted as any sheet conveyance path in general formed when the swing door 20 is set in the closed posture S1.

Although the inclined oblong holes 50 are illustrated as oblong holes into which the rotary shafts 40 are fitted in the foregoing embodiment, the oblong holes may be such as to extend from the inner side of the apparatus main body 11 to the outer side thereof, i.e. such as to have no inclination. In such a case, specified rotary-shaft shifting means (e.g. biasing springs) may be provided to locate the rotary shafts 40 at the inner sides of the oblong holes in the case where the swing door 20 is supported in the closed posture S1 (first supported posture) and to locate the rotary shafts 40 at the outer sides of the oblong holes in the case where the swing door 20 is supported in the opened posture S2 (second supported posture).

This application is based on patent application No. 2005-011265 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus having a swing door provided on an apparatus main body, comprising:

a swing-door supporting structure for rotatably supporting the swing door at a position of a supporting point of rotation, and an inverting conveyance path for discharging a sheet while inverting the sheet, wherein the swing-door supporting structure forms the inverting conveyance path of a specified width with the swing door closed and wherein the swing-door supporting structure is configured such that the swing door is moved in a direction away from the inverting conveyance path as the swing door is rotated into an open position, the swing-door supporting structure includes a rotary shaft integrally projecting from a bottom end position of the swing door along a sheet width direction orthogonally intersecting a sheet conveying direction; and an oblong hole formed in the apparatus main body, inclined downward toward an outer side of the apparatus main body and adapted to support the rotary shaft, the rotary shaft includes a projection fixed thereto in such a manner as to extend in lateral direction toward an inner side of the apparatus main body with the swing door closed, and the oblong hole is formed at an upper position thereof with a recessed groove into which the projection is fitted with the swing door closed.

2. An image forming apparatus according to claim 1, wherein the swing door is usable as a discharge tray for receiving the sheet after a fixing processing by being opened.

3. An image forming apparatus according to claim 1, wherein an upstream end of the inverting conveyance path is connected with that of a returning conveyance path for returning the sheet after a fixing processing having printing completed on one surface to an image forming unit upon applying duplex printing to the sheet.

4. An image forming apparatus having a swing door provided on an apparatus main body, comprising:

a swing-door supporting structure for rotatably supporting the swing door at a position of a specified supporting point of rotation, and a sheet conveyance path for conveying a sheet, wherein the swing-door supporting structure supports the swing door at least in:

a first supported posture where the swing door is supported in a closed state to define the sheet conveyance path of a specified width by utilizing the inner wall surface of the swing door, and a second supported posture where the swing door is supported in an opened state by moving the position of the supporting point of rotation of the swing door in a direction away from the sheet conveyance path.

5. An image forming apparatus according to claim 4, wherein:

the swing-door supporting structure includes a rotary shaft integrally projecting from a bottom end position of the swing door along a sheet width direction orthogonally intersecting a sheet conveying direction; and an oblong hole formed in the apparatus main body, extending from an inner side of the apparatus main body to an outer side thereof and adapted to support the rotary shaft, and the rotary shaft is located at an inner side of the oblong hole if the swing door is supported in the first supported posture while being located at an outer side of the oblong hole if the swing door is supported in the second supported posture.

6. An image forming apparatus according to claim 4, wherein:

the swing-door supporting structure includes a rotary shaft integrally projecting from a bottom end position of the swing door along a sheet width direction normal to a sheet conveying direction, and an oblong hole formed in the apparatus main body, inclined downward toward an outer side of the apparatus main body and adapted to support the rotary shaft, the rotary shaft includes a projection fixed thereto in such a manner as to extend in lateral direction toward the inner side of the apparatus main body with the swing door closed, and the oblong hole is formed at an upper position thereof with a recessed groove into which the projection is fitted with the swing door closed.

7. An image forming apparatus according to claim 4, wherein the swing door is usable as a discharge tray for receiving the sheet after a fixing processing by being opened.

* * * * *